US009434180B2

(12) United States Patent
Onodera et al.

(10) Patent No.: US 9,434,180 B2
(45) Date of Patent: Sep. 6, 2016

(54) INK JET PRINTER, PRINT OBJECT RETAINING MEMBER, AND PRINT METHOD

(71) Applicant: MIMAKI ENGINEERING CO., LTD., Nagano (JP)

(72) Inventors: Akihiro Onodera, Tokyo (JP); Masashi Hirano, Tokyo (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/421,841

(22) PCT Filed: Aug. 23, 2013

(86) PCT No.: PCT/JP2013/072515

§ 371 (c)(1),
(2) Date: Feb. 16, 2015

(87) PCT Pub. No.: WO2014/034542

PCT Pub. Date: Mar. 6, 2014

(65) Prior Publication Data

US 2015/0210086 A1 Jul. 30, 2015

(30) Foreign Application Priority Data

Aug. 27, 2012 (JP) ..... 2012-186788

(51) Int. Cl.
*B41J 23/00* (2006.01)
*B41F 15/26* (2006.01)
(Continued)

(52) U.S. Cl.
CPC ..... *B41J 3/4073* (2013.01); *B41J 2/01* (2013.01); *B41M 5/0088* (2013.01)

(58) Field of Classification Search
CPC ..... B41J 3/4073; B41J 2/01; B41J 3/283; B41J 3/286; B29C 67/0059
See application file for complete search history.

(56) References Cited

U.S. PATENT DOCUMENTS 6,923,115 B1 * 8/2005 Litscher ..... B41F 17/30 101/35
2001/0003871 A1 * 6/2001 Patton ..... B41J 3/4073 33/18.1

(Continued)

FOREIGN PATENT DOCUMENTS

CN 102066007 5/2011
CN 102173211 9/2011

(Continued)

OTHER PUBLICATIONS

"International Search Report (Form PCT/ISA/210)", mailed on Oct. 1, 2013, with English translation thereof, pp. 1-4, in which three of the listed references (JP2010-125757, JP2001-347656, JP2012-86511 and JP2004-123025) were cited.

(Continued)

*Primary Examiner* — Matthew Luu
*Assistant Examiner* — Patrick King
(74) *Attorney, Agent, or Firm* — Jianq Chyun IP Office

(57) ABSTRACT

An ink jet printer that appropriately performs printing with high accuracy on a three-dimensional object for a portable terminal is provided. The ink jet printer includes an ink jet head that discharges ink droplets, and a print object retaining section that retains a three-dimensional objects. The print object retaining section includes a shaft member extending in a direction perpendicularly intersecting a discharging direction of the ink droplets, a housing section being a shaft retaining section that retains the shaft member in a rotatable manner, a work set member being a three-dimensional object fixing member that is a fixing member fixing the three-dimensional objects relative to the shaft member, and causes the three-dimensional objects to rotate together with the shaft member by being fixed relative to the shaft member, and a rotation driving section being a rotation stopping means for stopping rotation of the shaft member at a predeterminedly set position.

5 Claims, 3 Drawing Sheets

(51) Int. Cl.

| | |
|---|---|
| ***B41J 3/407*** | (2006.01) |
| ***B41J 2/01*** | (2006.01) |
| *B41M 5/00* | (2006.01) |

(56) References Cited

U.S. PATENT DOCUMENTS

| | | | | |
|---|---|---|---|---|
| 2002/0067940 | A1* | 6/2002 | Sasai | B41J 3/4071 400/61 |
| 2010/0186610 | A1* | 7/2010 | Polk | B41J 3/4073 101/35 |
| 2013/0342592 | A1* | 12/2013 | Merz | B41J 3/4073 347/2 |

FOREIGN PATENT DOCUMENTS

| | | |
|---|---|---|
| JP | 2001-347656 | 12/2001 |
| JP | 2004-123025 | 4/2004 |
| JP | 2010-125757 | 6/2010 |
| JP | 2010-158874 | 7/2010 |
| JP | 2011-20112 | 2/2011 |
| JP | 2012-86511 | 5/2012 |
| WO | WO 2008118171 A1 * | 10/2008 |

OTHER PUBLICATIONS

"1st Office Action of China Counterpart Application", issued on Sep. 4, 2015, p. 1-p. 17, with English translation thereof.

* cited by examiner

INK JET PRINTER, PRINT OBJECT RETAINING MEMBER, AND PRINT METHOD

CROSS-REFERENCE TO RELATED APPLICATION

This application is a 371 application of the International PCT application serial no. PCT/JP2013/072515, filed on Aug. 23, 2013, which claims priority benefits of Japan Patent Application No. 2012-186788 filed on Aug. 27, 2012. The entirety of each of the above-mentioned patent applications is hereby incorporated by references herein and made a part of this specification.

TECHNICAL FIELD

The present invention relates to an ink jet printer, a print object retaining member, and a print method.

BACKGROUND ART

In recent years, a target of printing by an ink jet printer is not limited to a flat medium such as paper, film, or the like, but is encompassing three-dimensional objects having various shapes. Further, accompanying this, methods for retaining a print object (work) having various shapes is being considered. For example, conventionally, a method for performing three-dimensional sequential printing by mounting a work on a rotating means is known (for example, see Patent Document 1). Further, in case where the work is a rotator having a plurality of ink striking surfaces, there is a method for performing printing while rotating the rotator is known (for example, see Patent Document 2).

PRIOR ART DOCUMENTS

Patent Documents

Patent Document 1: JP 2011-20112 A
Patent Document 2: JP 2010-158874 A

SUMMARY OF THE INVENTION

Problems to be Solved by the Invention

To perform printing with high accuracy using an ink jet printer, a distance between an ink jet head and a print object needs to be sufficiently small. For example, in case of performing printing with high accuracy such as 600 dpi or more, a distance (gap distance) between the ink jet head and the work needs to be set at about equal to or less than 1.5 mm (for example, 1.0 to 1.5 mm).

However, if the work is a three-dimensional object, a mere fixation cannot maintain a constant gap distance due to concavo-convex shape of the three-dimensional object in some cases. Due to this, in case of performing printing on the three-dimensional object, it is important that the work is retained by a method fitting the shape.

Here, in recent years, demands for a cover for portable terminals are becoming large accompanying the widespread of the portable terminals such as smart phones. Thus, the inventor of the present application has conducted in-depth study on how a work should be retained in cases where printing is to be performed by an ink jet printer on a three-dimensional object having a shape such as the cover for the portable terminals such as smart phones.

In case of performing printing on a cover and the like for a portable terminal, aside from a surface covering a rear surface of the terminal, it is desirable to perform printing also on a side surface that intersects with the aforesaid surface. Further, since it is a product with superior design being desired, printing with high accuracy is desired. On the other hand, since it is a cheap product compared to a main body and the like of the portable terminal, it is desirable to perform the printing at lower cost.

With respect to this, in case of using the method disclosed for example in Patent Document 1, there is a risk that control of a rotating means becomes difficult in the event of attempting to suitably set both of an angle for retaining a work and a narrow gap distance by which printing with high accuracy is enabled for each of the print surfaces. Further, as a result, there is a risk that cost of the printing becomes high. Further, a cover and the like for a portable terminal cannot be said as being a rotator. Due to this, it is also difficult to perform printing with high accuracy with the method of Patent Document 2.

Due to this, conventionally, a method for appropriately performing printing by an ink jet printer on a work having a shape such as a cover and the like for a portable terminal was desired. Thus, the present invention aims to provide an ink jet printer, a print object retaining member, and a print method that can solve the above problems.

Solutions to the Problems

To solve the above problems, the present invention has the following configurations.

(Configuration 1) An ink jet printer that performs printing using an ink jet scheme on a three-dimensional object, the ink jet printer including: an ink jet head that discharges ink droplets; and a print object retaining section that retains the three-dimensional object being a printing target so as to face the ink jet head, wherein the three-dimensional object being the printing target at least includes, as a print surface to be printed by the ink jet printer, a first print surface, and a second print surface being a side surface relative to the first print surface, the print object retaining section includes a shaft member extending in a direction perpendicularly intersecting a direction along which the ink jet head discharges the ink droplets, a shaft retaining section that retains the shaft member in a rotatable manner, a three-dimensional object fixing member that is a fixing member fixing the three-dimensional object relative to the shaft member and causes the three-dimensional object to rotate together with the shaft member by being fixed relative to the shaft member, and a rotation stopping means for stopping rotation of the shaft member at a predeterminedly set position, the rotation stopping means stops the rotation of the shaft member at a first angle by which the first print surface faces the ink jet head in case of performing printing on the first print surface of the three-dimensional object, and the rotation stopping means stops the rotation of the shaft member at a second angle by which the second print surface faces the ink jet head in case of performing printing on the second print surface of the three-dimensional object. The three-dimensional object fixing member is for example fixed relative to the shaft member in a state of having the shaft member penetrating therethrough. The three-dimensional object to be the printing target is for example a cover for a portable terminal such as a smart phone.

By configuring as above, for example, each print surface of the three-dimensional object to be the printing target can be caused to appropriately face the ink jet head with high accuracy. Further, according to this, printing with high accuracy can appropriately be performed.

Notably, the configuration corresponding to the print object retaining section can for example be said as being a rotation device of a print object for ink jet printing. Further, in this case, a configuration of the rotation device of the print object for ink jet printing can for example be said as being characteristic in including a rotating means for retaining and rotating the print object, and a stopping means (for example, stepping motor and the like) for stopping rotation of the print object at a predetermined stopping position.

Further, for this configuration as well, since the rotation can accurately be stopped, it can be said that interference of both members can appropriately be suppressed even if a gap distance between the ink jet head and the print object is for example about 1.0 to 1.5 mm. Further, since the rotation of the print object can be stopped accurately, a posture of the print object can accurately be positioned. Due to this, by configuring as above, for example, it can be said that the gap distance relative to the ink jet head from one end of the print object to the other end thereof in a rotating direction can be made uniform. Further, according to this, print quality can appropriately be improved.

(Configuration 2) The rotation stopping means includes a stepping motor, and a timing belt that causes the shaft member to rotate in accordance with rotation of the stepping motor. By configuring as above, control of a rotation angle of the shaft member can be performed appropriately with high accuracy.

(Configuration 3) A retaining section-driving section that relatively moves the print object retaining section relative to the ink jet head in the direction along which the ink jet head discharges the ink droplets is further provided, wherein the retaining section-driving section causes a distance between the ink jet head and the first print surface upon printing on the first print surface, and a distance between the ink jet head and the second print surface upon printing on the second print surface to be in a range of 1.0 to 1.5 mm by relatively moving the print object retaining section relative to the ink jet head. By configuring as above, the printing on the three-dimensional object can be performed even more appropriately with higher accuracy.

Notably, the distance (gap distance) between the ink jet head and the print surface is for example a distance between openings of nozzles for discharging ink droplets in the ink jet head and the print surface. In case where the gap distance is large, the ink droplets easily turn into mist, so there are cases where appropriately performing printing with high accuracy is difficult. Further, in case where the gap distance is too small, there is a risk that the ink jet head and the three-dimensional object collide by an influence of vibration upon print operation, or of concavo-convex shape on the print surface.

(Configuration 4) The first print surface is a surface larger than the second print surface, and the ink jet printer performs the printing on the first print surface later than the printing on the second print surface.

The inventor of the present application has found, in his in-depth study regarding the present invention, that in case of performing printing by the ink jet printer on a plurality of intersecting surfaces, ink mist generated during printing on one surface adheres to another surface, whereby the other surface becomes dirty in some cases. Further, it has been found that this problem tends to occur for printing on narrower surfaces. Further, in the three-dimensional object being the printing target, a larger surface in many cases is an important surface that stands out in a visually sensible way. Due to this, the larger surface becoming dirty is normally not desirable.

With respect to this, by configuring as above, for example, even in a case where the first print surface became dirty by mist having been generated upon printing on the second print surface, the influence of the dirt can appropriately be reduced by the subsequent printing on the first print surface. Further, according to this, the printing with high accuracy can more appropriately be performed.

Notably, the first print surface for example is the largest print surface (hereinbelow referred to as a main print surface) within the surface of the three-dimensional object. The second print surface is for example a side surface intersecting with the main print surface. For example, if the three-dimensional object is a cover for the portable terminal such as a smart phone, the first print surface may be a surface that covers a rear surface of the portable terminal, or a part thereof. Further, the second print surface may be a surface covering one side surface of the portable terminal, or a part thereof. Further, in case of performing printing on other side surfaces (third print surface) of the three-dimensional object, the printing on the main print surface is preferably performed after the printing on all of the side surfaces.

(Configuration 5) The print object retaining section includes a plurality of the shaft members, and a plurality of the three-dimensional object fixing members, each of which is fixed to corresponding one of the plurality of the shaft members, and the rotation stopping means stops rotation of the plurality of the shaft members at the predeterminedly set position by causing the plurality of the shaft members to rotate with same rotation angle.

By configuring as above, one print retaining section can appropriately retain a plurality of three-dimensional objects. Further, according to this, printing on the plurality of three-dimensional objects can efficiently be performed. Moreover, by causing a plurality of shaft members to rotate with the same rotation angle, orientations of the plurality of three-dimensional objects can appropriately be controlled with high accuracy. Further, according to this, the printing on the plurality of three-dimensional objects with high accuracy can appropriately be performed.

(Configuration 6) The three-dimensional object fixing member retains two pieces of the three-dimensional objects so that rear surfaces of the first print surfaces in the two pieces of the three-dimensional objects face each other with the shaft member interposed therebetween. By configuring as above, one three-dimensional object fixing member can appropriately retain two pieces of the three-dimensional objects. Further, according to this, the printing on the three-dimensional objects can more efficiently be performed.

Notably, this configuration may be regarded as that it is a configuration in which a print object (cover and the like) is fixed to each of front and back of an attachment member that is rotatively driven by a drive shaft in a rotation device for a print object used for ink jet printing. In this case, the drive shaft is for example a configuration corresponding to the shaft member. Further, the attachment member is for example a configuration corresponding to the three-dimensional object fixing member.

In the rotation device for the print object used for ink jet printing, the rotation can accurately be stopped by the stopping means (for example, stepping motor and the like) that is a means for defining a rotation stopping position, even in case where the cover and the like is fixed to each of the front and back of the attachment member. Due to this, for example, even in case of printing on side surfaces of two covers and the like at the same time, the gap distances between the side surfaces of the two covers and the like and the ink jet head can mutually be equalized. Further, according to this, print quality can appropriately be improved.

(Configuration 7) A print object retaining member being a member used in an ink jet printer for performing printing using an ink jet scheme on a three-dimensional object, the print object retaining member being configured to retain the three-dimensional object being a printing target so as to face an ink jet head, wherein the three-dimensional object being the printing target at least includes, as a print surface to be printed by the ink jet printer, a first print surface, and a second print surface being a side surface relative to the first print surface, the print object retaining section includes a shaft member extending in a direction perpendicularly intersecting a direction along which the ink jet head discharges ink droplets, a shaft retaining section that retains the shaft member in a rotatable manner, a three-dimensional object fixing member that is a fixing member fixing the three-dimensional object relative to the shaft member, and causes the three-dimensional object to rotate together with the shaft member by being fixed relative to the shaft member, and a rotation stopping means for stopping rotation of the shaft member at a predeterminedly set position, the rotation stopping means stops the rotation of the shaft member at a first angle by which the first print surface faces the ink jet head in case of performing printing on the first print surface of the three-dimensional object, and the rotation stopping means stops the rotation of the shaft member at a second angle by which the second print surface faces the ink jet head in case of performing printing on the second print surface of the three-dimensional object. By configuring as above, for example, advantageous effects similar to Configuration 1 can be obtained.

(Configuration 8) A print method for performing printing using an ink jet scheme on a three-dimensional object, the method using: an ink jet head that discharges ink droplets; and a print object retaining section that retains the three-dimensional object being a printing target so as to face the ink jet head, wherein the three-dimensional object being the printing target at least includes, as a print surface to be printed by an ink jet printer, a first print surface, and a second print surface being a side surface relative to the first print surface, the print object retaining section includes a shaft member extending in a direction perpendicularly intersecting a direction along which the ink jet head discharges the ink droplets, a shaft retaining section that retains the shaft member in a rotatable manner, a three-dimensional object fixing member that is a fixing member fixing the three-dimensional object relative to the shaft member, and causes the three-dimensional object to rotate together with the shaft member by being fixed relative to the shaft member, and a rotation stopping means for stopping rotation of the shaft member at a predeterminedly set position, the rotation stopping means stops the rotation of the shaft member at a first angle by which the first print surface faces the ink jet head in case of performing printing on the first print surface of the three-dimensional object, and the rotation stopping means stops the rotation of the shaft member at a second angle by which the second print surface faces the ink jet head in case of performing printing on the second print surface of the three-dimensional object. By configuring as above, for example, advantageous effects similar to Configuration 1 can be obtained.

Effects of the Invention

According to the present invention, for example, printing with high accuracy can appropriately be performed on a three-dimensional object such as a cover and the like for a portable terminal.

BRIEF DESCRIPTION OF THE DRAWINGS

FIG. 1A shows an example of a function and configuration of a primary portion of the ink jet printer 10. FIG. 1B shows an example of a more specific configuration of an entirety of the ink jet printer 10.

FIG. 2A is a perspective diagram showing the print object retaining section 18 in a state of being assembled to a main body of the ink jet printer 10. FIG. 2B is a perspective diagram showing an overall configuration of the print object retaining section 18. FIG. 2C is an exploded schematic view showing the shaft, two pieces of three-dimensional objects, and the work set member which retains the two pieces of three-dimensional objects.

EMBODIMENTS OF THE INVENTION

Figure 1A:
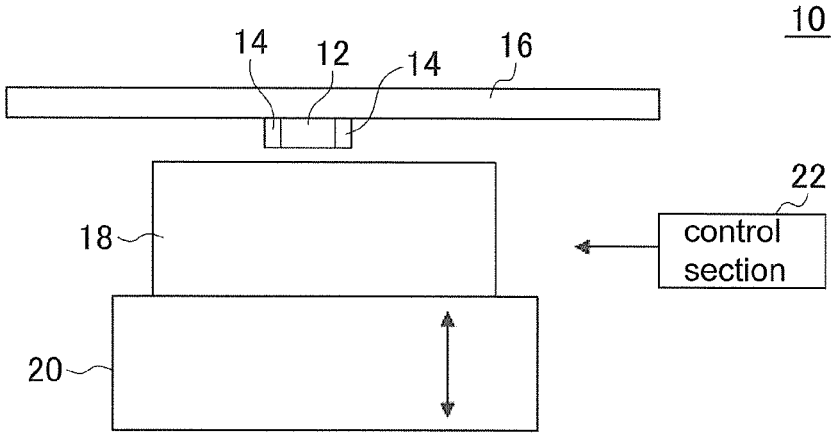
FIG. 1A and FIG. 1B are diagrams showing an example of a configuration of an ink jet printer 10 according to one embodiment of the present invention.
Figure 1B:
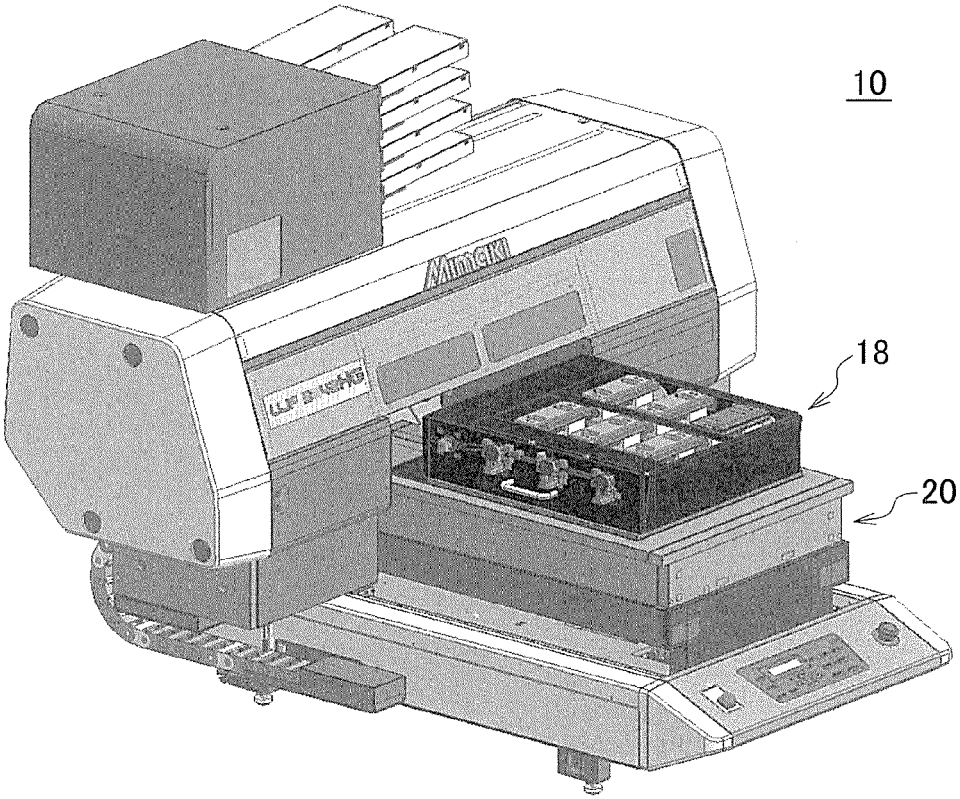

Hereinbelow, embodiments according to the present invention will be described with reference to the drawings. FIG. 1A and FIG. 1B show an example of a configuration of an ink jet printer 10 according to one embodiment of the present invention. FIG. 1A shows an example of a function and configuration of a primary portion of the ink jet printer 10.

In this example, the ink jet printer 10 is a print device that performs printing using an ink jet scheme on a three-dimensional object, and performs printing on a cover for a portable terminal such as a smart phone. The cover for the portable terminal is an example of the three-dimensional object having at least a first print surface and a second print surface being a side surface relative to the first print surface. The three-dimensional object being a printing target may be a cover-type member other than the cover for the portable terminal.

Further, the ink jet printer 10 includes an ink jet head 12, an ultraviolet ray irradiating section 14, a guide rail 16, a print object retaining section 18, a retaining section-driving section 20, and a control section 22. The ink jet head 12 is a print head that discharges ink droplets on the three-dimensional object being the printing target. In this example, the ink jet head 12 discharges ink droplets of ultraviolet curing ink. Further, the ink jet head 12 performs color printing, for example by discharging ink droplets of each color for CMYK. The ink jet head 12 may further discharge white ink, clear ink, and the like. The ultraviolet ray irradiating section 14 is a light source for generating ultraviolet ray for curing the ink.

The guide rail 16 is a rail-shaped member extending in a predetermined main scanning direction, and causes the ink jet head 12 to perform main scanning operation (scan operation) upon printing. In the scan operation, the ink jet head 12 discharges the ink droplets while moving in the main scanning direction along the guide rail 16.

The print object retaining section 18 is a retaining member that retains the print object being the three-dimensional object that is the printing target by causing it to face the ink jet head 12, and retains the three-dimensional object so that a print surface in the three-dimensional object faces the ink jet head 12. The detailed configuration of the print object retaining section 18 will be described later in detail.

The retaining section-driving section 20 is a driving mechanism for moving the print object retaining section 18. In this example, the retaining section-driving section 20 for example moves the print object retaining section 18 in an ink droplet discharging direction. The ink droplet discharging direction is a direction along which the ink jet head 12 discharges the ink droplets. According to this, the retaining section-driving section 20 adjusts a gap distance between the print surface in the three-dimensional object and the ink jet head 12. The retaining section-driving section 20 for example moves the print object retaining section 18 within a range of 5 cm or so in an up and down direction. Further, the adjustment of the gap distance can be performed for example by moving the ink jet head 12 side. In this case, the retaining section-driving section 20 for example moves the guide rail 16 so that the print object retaining section 18 is moved in a relative manner with respect to the ink jet head 12.

Further, in this example, the retaining section-driving section 20 can move the print object retaining section 18 also in the main scanning direction and a sub scanning direction. The sub scanning direction is a direction perpendicularly intersecting the ink droplet discharging direction and the main scanning direction. According to this, the retaining section-driving section 20 for example performs positioning of the three-dimensional object relative to the ink jet head 12.

Further, the retaining section-driving section 20 of the present example further moves the retaining section-driving section 20 in the sub scanning direction in an interval between scan operations of the ink jet head 12. According to this, the retaining section-driving section 20 sequentially transfers the three-dimensional object being the printing object in a relative manner with respect to the ink jet head 12 in the sub scanning direction.

The control section 22 is for example a CPU of the ink jet printer 10, and controls operations of respective sections of the ink jet printer 10 based on instructions received from an external host PC, and program and the like such as firmware, for example. For example, the control section 22 controls the orientation of the three-dimensional object retained by the print object retaining section 18 by controlling the operation of the print object retaining section 18. Further, for example, the positioning of the three-dimensional object being the printing target is performed by controlling the operation of the retaining section-driving section 20. Moreover, for example, the ink jet head 12 is caused to perform printing on the print surface of the three-dimensional object by controlling the operation of the ink jet head 12 and the print object retaining section 18.

FIG. 1B is a diagram showing an example of a more specific configuration of an entirety of the ink jet printer 10, and shows a perspective diagram of the ink jet printer 10 in a state of letting the retaining section-driving section 20 and the print object retaining section 18 out on the outside of the main body of the ink jet printer 10. In this example, as the main body of the ink jet printer 10, for example, a print device of UJF-3042HG (registered trademark) manufactured by Mimaki Engineering Co., Ltd. can suitably be used. This print device is an ink jet printer capable of performing printing on the three-dimensional object placed in a region of 30 cm×42 cm. Further, in this case, for example, the functions of the ink jet head 12, the ultraviolet ray irradiating section 14, the guide rail 16, the retaining section-driving section 20, and the control section 22 can be implemented by the functions of the main body of the print device. Further, the print object retaining section 18 can be placed with high accuracy by using a hole section and the like for positioning provided in a member corresponding to the retaining section-driving section 20. Moreover, for example, printing with high resolution of 600 dpi or more (for example, 720×600 dpi, 1,440×1,200 dpi, etc.) can appropriately be performed.

As above, according to the present example, printing on the three-dimensional object can be performed appropriately with high accuracy.

Next, the detailed configuration of the print object retaining section 18 will be described in greater detail.

Figure 2A:
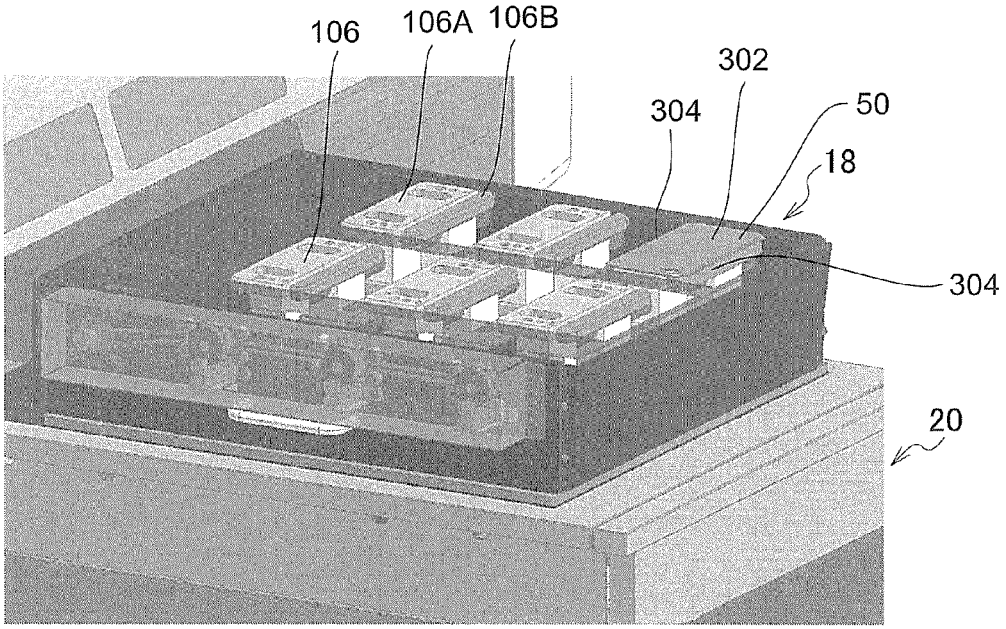
FIG. 2A, FIG. 2B and FIG. 2C are diagrams showing an example of a detailed configuration of a print object retaining section 18.
Figure 2B:
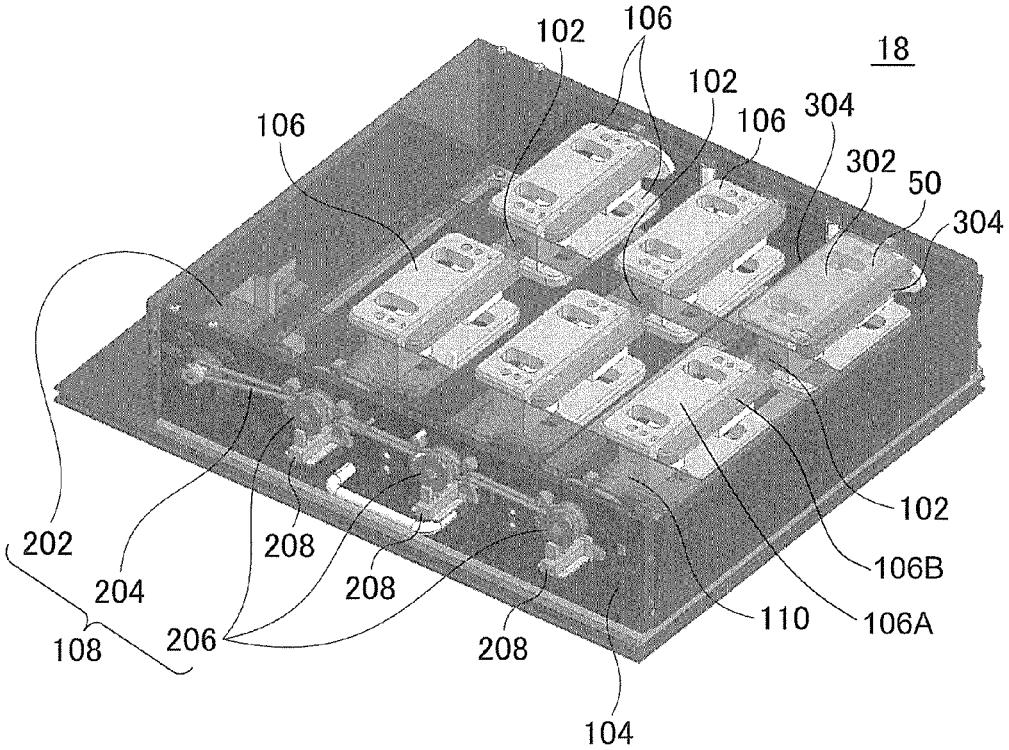

FIG. 2A and FIG. 2B show an example of the detailed configuration of the print object retaining section 18. FIG. 2A is a perspective diagram showing the print object retaining section 18 in a state of being assembled to a main body of the ink jet printer 10 (see FIG. 1A and FIG. 1B). FIG. 2B is a perspective diagram showing an overall configuration of the print object retaining section 18.

In this example, the print object retaining section 18 is a member for retaining plural pieces of three-dimensional objects 50 being covers for the portable terminal such as a smart phone, and includes a plurality of shaft members 102, a housing section 104, a plurality of work set members 106, a rotation driving section 108, a plurality of angle detectors 208, and a plurality of springs 110. The plurality of shaft members 102 are driving shafts for rotating the three-dimensional objects 50 so that the print surfaces of the three-dimensional objects 50 face the ink jet head 12 (see FIG. 1A and FIG. 1B). In this example, each of the shaft members 102 is retained by the housing section 104 by being oriented to extend in the main scanning direction, which is an example of the direction perpendicularly intersecting the ink droplet discharging direction.

The housing section 104 is a housing portion of the print object retaining section 18. In this example, the housing section 104 is a box shape with a side that faces the ink jet head 12 upon printing opened, and retains the respective shaft members 102 in a rotatable manner by supporting one ends and the other ends of the respective shaft members 102 by its two facing side surfaces. Further, according to this, the housing section 104 functions as a shaft retaining section.

Notably, the housing section 104 retains the plurality of shaft members 102 in a state where heights being positions in the ink droplet discharging direction are the same. Further, in the housing section 104, bearing portions that support the one ends and the other ends of the shaft members 102 are preferably configured by ball bearings, for example. By configuring as above, the shaft members 102 can be retained more appropriately.

Each of the plurality of work set members 106 is an example of the three-dimensional object fixing member for mounting the three-dimensional object 50 being the printing target at a predetermined printable position. In this example, each of the work set members 106 is fixed to one of the shaft member 102 in a state of having the corresponding shaft member 102 penetrating therethrough, and fixes the three-dimensional object 50 relative to the shaft member 102. Further, according to this, the work set members 106 cause the three-dimensional objects 50 to rotate together with the shaft members 102 in accordance with rotation of the shaft members 102.

Here, in this example, the three-dimensional object 50 being the cover for covering the back surface of the portable terminal and the like includes a main print surface 302 and a pair of side surfaces 304. The main print surface 302 is an example of the first print surface. The pair of side surfaces 304 are surfaces intersecting with the main print surface 302. Further, one of the pair of side surfaces 304 is an example of the second print surface that is narrower than the first print surface. The other of the pair of side surfaces 304 is an example of the third print surface. Further, the back surface side of the main print surface 302 for the three-dimensional object 50 is opened, due to its structure for covering the portable terminal and the like.

Further, in this example, each of the work set members 106 retains the three-dimensional object 50 by pressing at least a part of the three-dimensional object 50 on an inner surface side. The inner surface side of the three-dimensional object is for example a back surface side of the print surface in the three-dimensional object. More specifically, in this example, the work set members 106 for example have a shape of the portion corresponding to the portable terminal that is to be a target that the three-dimensional objects 50 are to cover. Further, the cover-shaped three-dimensional objects 50 are attached to this portion. Further, according to this, the work set members 106 retain the three-dimensional objects 50.

Figure 2C:
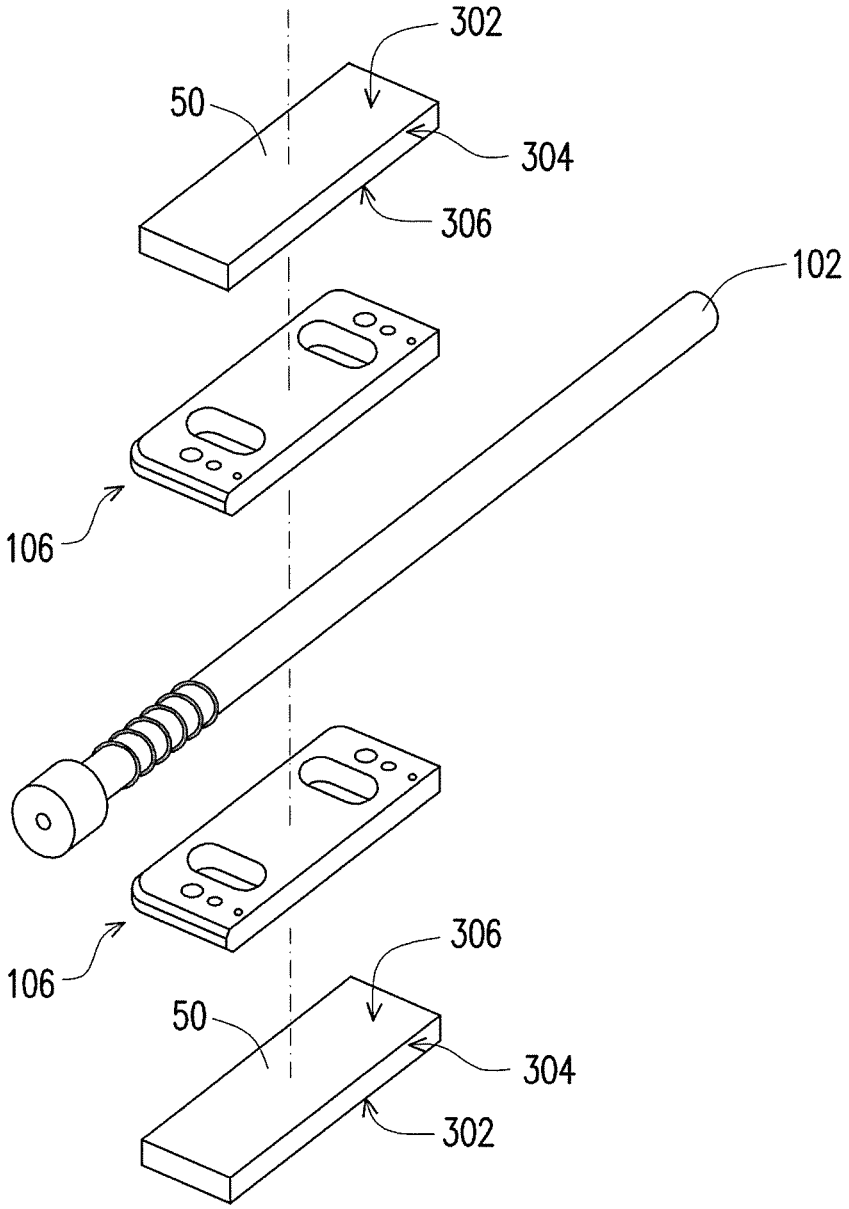

Further, each of the work set member 106 retains two pieces of three-dimensional objects 50 so that the rear surfaces 306 of the main print surfaces 302 of the two pieces of three-dimensional objects 50 face each other with the shaft member 102 interposed therebetween, as shown in FIG. 2C. Herein, FIG. 2C is merely to schematically show the relative positions of the three-dimensional objects 50, the work set members 106 and the shaft member 102 according to one embodiment of the present invention, and the structures of the three-dimensional objects 50, the work set members and the shaft member 102 should not be limited to FIG. 2C. Moreover, each of the shaft members 102 has two pieces of work set members 106 attached thereto. Due to this, according to this example, a large number of three-dimensional objects 50 can simultaneously be retained by the print object retaining section 18.

Notably, in FIG. 2A and FIG. 2B, for the sake of convenience of depiction, a state in which the three-dimensional objects 50 are mounted only on one work set member 106 is shown. However, in actual printing, two pieces of three-dimensional objects 50 are retained on each work set member 106. Further, in the configuration as shown, the print object retaining section 18 includes three pieces of shaft members 102. Due to this, in this case, the print object retaining section 18 retains a total of twelve pieces of three-dimensional objects 50.

The rotation driving section 108 is a driving section for rotating the plurality of shaft members 102. In this example, the rotation driving section 108 includes a plurality of pulleys 206, a stepping motor 202, and a timing belt 204. Each of the plurality of pulleys 206 is connected to corresponding one end of the plurality of shaft members 102, and causes the corresponding shaft member 102 to rotate in accordance with the rotation of itself.

The stepping motor 202 is a motor that rotates in accordance with instructions received from the control section 22 (see FIG. 1A and FIG. 1B). The stepping motor 202 may for example receive instructions on rotation from the external host PC via the control section 22.

The timing belt 204 connects each of the plurality of pulleys 206 and the stepping motor 202, and causes the respective pulleys 206 and shaft members 102 to rotate in accordance with rotation amount of the stepping motor 202. Further, in this example, the timing belt 204 is installed so that rotation amount is the same for each pulley 206. According to this, the timing belt 204 drives the plurality of shaft members 102 simultaneously according to the rotation amount of the stepping motor 202, sets the angle to be the same, and causes them to rotate by the same rotation amount.

The angle detectors 208 are detectors for detecting the rotation angles of the pulleys 206. By using the angle detectors 208, relationship and the like of the rotation amount of the stepping motor 202 and the rotation amounts of the respective shaft members 102 can appropriately be corrected. Further, for example, initial angles of the shaft members 102, a synchronization accuracy of the rotation amounts of the plurality of shaft members 102, and the like can appropriately be checked.

The springs 110 are coiled springs, and are attached between the side surface of the housing section 104 and the one ends of the work set members 106 in a state of having the shaft members 102 penetrating therethrough. Further, according to this, the springs 110 press out the work set members 106 to a direction separating away from the side surface of the housing section 104. By configuring as above, for example, the position accuracy of the work set members 106 in an axial direction of the shaft members 102 can further be improved.

By configuring as above, for example, the main print surface 302 and the respective side surfaces 304 of the three-dimensional object 50 can be caused to appropriately face the ink jet head 12 by rotating the plurality of shaft members 102. Due to this, according to the present example, printing can appropriately be performed for entire surfaces of the main print surface 302 and side surfaces 304 of the three-dimensional object 50.

Further, in this example, the control of the rotation angles of the shaft members 102 can be performed appropriately with high accuracy by using the stepping motor 202 and the timing belt 204 and the like. Further, especially, the rotation of the shaft members 102 can be stopped with high accuracy at the angle by which the respective print surfaces of the three-dimensional objects 50 are caused to face the ink jet head 12. Further, according to this, the rotation driving section 108 functions as the rotation stopping means for stopping the rotation of the plurality of shaft members 102 at the predeterminedly set position.

More specifically, for example, in case of performing printing on the main print surfaces 302 of the three-dimensional objects 50 being the first print surfaces, the rotation driving section 108 stops the rotation of the shaft members 102 at a first angle by which the main print surfaces 302 are caused to face the ink jet head 12. Further, in case of performing printing on the side surfaces 304 of the three-dimensional objects 50 being the second and third print surfaces, the rotation stopping means stops the rotation of the shaft members 102 at second and third angles by which the corresponding side surfaces 304 are caused to face the ink jet head 12. By configuring as above, each surface of the three-dimensional objects 50 can be caused to appropriately face the ink jet head 12 with high accuracy.

Further, in the ink jet printer 10 of the present example, the print object retaining section 18 moves in accordance with the operation of the retaining section-driving section 20 (see FIG. 1A and FIG. 1B). Further, according to this, in addition to changing the orientation of the three-dimensional objects 50 by the rotation of the shaft members 102, the distances (gap distances) between the ink jet head 12 and the print surfaces are adjusted. For example, by moving the print object retaining section 18 in a relative manner with respect to the ink jet head 12, the retaining section-driving section 20 adjusts the distances between the ink jet head 12 and the main print surfaces 302 upon the printing onto the main print surfaces 302 of the three-dimensional objects 50, and the distances between the ink jet head 12 and the side surfaces 304 upon the printing onto the side surfaces 304 to be in the range of 1.0 to 1.5 mm.

By configuring as above, for example, even in the case where the orientation of the three-dimensional objects 50 is changed by the rotation of the shaft members 102, the appropriate gap distance can be maintained. Due to this, according to the present example, printing can appropriately be performed with high accuracy for each surface of the three-dimensional objects 50.

Further, to more appropriately perform printing with high accuracy, it is preferable to consider an order by which the respective surfaces of the three-dimensional objects 50 are printed as well. For example, the ink jet printer 10 preferably performs the printing on the main print surfaces 302 that stand out the most in the three-dimensional objects 50 later than the printing on the side surfaces 304. More specifically, for example, as for the two pieces of the three-dimensional objects 50 retained by one piece of work set member 106, firstly the printing on the side surfaces 304 on one side of the two pieces of three-dimensional objects 50 is performed, and then the shaft member 102 is rotated by 180 degrees, and the printing is performed on the side surfaces 304 on the other side. Subsequently, the shaft member 102 is rotated by 90 degrees or 270 degrees, and the printing is performed on the main print surfaces 302 of one of the three-dimensional objects 50. Further, the shaft member 102 is rotated by 180 degrees, and the printing is performed on the main print surfaces 302 of the other three-dimensional object 50. By configuring as above, for example, even in cases where mist is generated in the printing of the side surfaces 304 and the main print surfaces 302 became dirty, the printing on the main print surfaces 302 taking place thereafter can appropriately reduce the influence of the dirt. Further, according to this, printing with high accuracy can more appropriately be performed.

Notably, upon printing on the three-dimensional objects 50, it may be considered to rotate the shaft members 102 manually for example, if it was to merely change the orientation of the three-dimensional objects 50. However, in this case, it is difficult to stop the rotation accurately at the predetermined rotation stopping position by such a mere manual rotation. Especially, in cases where the gap distance is to be set equal to or less than 1.5 mm or so, it is difficult to realize sufficient accuracy by the manual rotation.

Further, to change the orientation of the three-dimensional objects 50, for example, instead of using the stepping motor 202 and the timing belt 204 as in the present example, a normal motor and a belt and the like may be considered to be used. However, in this case, slip may occur in the belt being driven, and a possibility of an error generation in the rotation angles becomes high. Especially, as in the present example, in the case of synchronizing and simultaneously rotating the plurality of shaft members 102, there is a risk that it becomes difficult to make the same rotation angle for the shaft members 102 due to the influence of the generated error. Further, in case of setting industrial products such as covers and the like for the portable terminal as the printing target, if frequency of rotation error generation becomes high, productivity may be decreased to a great extent. Due to this, a simple use of the normal motor and belt and the like in some cases would be difficult to appropriately perform printing with high accuracy.

In contrast, in this example, the configuration that rotates the shaft members 102 by using the stepping motor 202, the timing belt 204 and the like allows the three-dimensional objects 50 to appropriately rotate with high accuracy. Further, the gap distances can be adjusted in accordance with the positions of the print surfaces by the print object retaining section 18. Due to this, according to the present example, printing with high accuracy can appropriately be performed on each surface of the three-dimensional objects 50.

Further, as is apparent from the foregoing description and the like, in the rotation driving section 108 of the present example, it can be said that the function as the rotation stopping means to stop the rotation of the shaft members 102 at the predeterminedly set position is especially important. Due to this, if the function as the rotation stopping means can appropriately be implemented, configurations other than the configuration using the stepping motor 202 and the timing belt 204 may be considered. In this case as well, printing with high accuracy can appropriately be performed on each surface of the three-dimensional objects 50.

Next, hereinbelow the more specific configuration and the like of the print object retaining section 18 will be supplemented.

Firstly, the more specific configuration of the work set members 106 will be described. In this example, each work set member 106 has a configuration of being divided into two in a width direction (denoted by signs 106A, 106B) as shown in FIG. 2A and FIG. 2B. Further, the portions divided into two are connected by a spring.

In configuring as above, for example, it becomes possible to attach the three-dimensional objects 50 to the work set members 106 in a state where the springs are compressed, so the attachment of the three-dimensional objects 50 to the work set members 106 becomes even easier. Further, after the attachment, each three-dimensional object 50 can be pressed from inner sides on both of the side surfaces 304 by biasing force of the spring. Due to this, by configuring as above, for example, even in case where the three-dimensional objects 50 attached to the work set members 106 are rotated, the three-dimensional objects 50 are appropriately prevented from falling down or the like.

Next, positional accuracy of the work set members 106, the three-dimensional objects 50 and the like will be described. As described above, in this example, the gap distances between the print surfaces and the ink jet head 12 are for example 1.0 to 1.5 mm. Due to this, attachment accuracy of the respective members and rotation accuracy of the shaft members 102 need to correspond to the gap distances.

For example, an error in the attachment accuracy of the shaft members 102 and the work set members 106 is preferably equal to or less than 0.1 mm in each direction, for example. This error is more preferably equal to or less than 0.05 mm. Further, an error in rotation amount of the shaft members 102 and the work set members 106 that rotate in accordance with the rotation of the stepping motor 202 is preferably equal to or less than 1 degrees. This error is more preferably equal to or less than 0.5 degrees.

Further, to mitigate the error in the rotation amount of the shaft members 102 and the work set members 106, it is also important to set the initial position of the work set members 106 with high accuracy. Further, to confirm such setting, for example, a method that overlaps a flat, plate-shaped member on all of the work set members 106 in the print object retaining section 18 is effective. More specifically, for example, the plate-shaped member is overlapped on all of the work set members 106 in a state where the surfaces of the work set members 106 corresponding to the main print surfaces 302 of the three-dimensional objects 50 face upward. By so doing, for example, a work set member 106 that is tilted relative to other work set members 106 can appropriately be found. Further, according to this, the initial position of all of the work set members 106 can be set with high accuracy.

As above, the present invention was described by referring to embodiments, however, the technical scope of the present invention is not limited to the scope described in the above embodiments. It is apparent to those skilled in the art that various modifications and alterations can be made to the above embodiments. It is also apparent from the description of the claims that embodiments including such modifications and alterations are also included in the technical scope of the present invention.

INDUSTRIAL APPLICABILITY

The present invention can suitably be adapted for example to an ink jet printer.

REFERENCE SIGNS LIST

10: Ink Jet Printer,
12: Ink Jet Head,
14: Ultraviolet Ray Irradiating Section,
16: Guide Rail,
18: Print Object Retaining Section,
20: Retaining Section-Driving Section,
22: Control Section,
50: Three-Dimensional Object,
102: Shaft Member,
104: Housing Section (Shaft Retaining Section),
106: Work Set Member (Three-Dimensional Object Fixing Member),
108: Rotation Driving Section (Rotation Stopping Means),
110: Spring,
202: Stepping Motor,
204: Timing Belt,
206: Pulley,
208: Angle Detector,
302: Main Print Surface,
304: Side Surface

The invention claimed is:

1. An ink jet printer that performs printing using an ink jet scheme on a plurality of three-dimensional objects simultaneously, wherein shapes of the plurality of three-dimensional objects are substantially identical, the ink jet printer comprising:

an ink jet head that discharges ink droplets; and a print object retaining section that retains the plurality of three-dimensional objects being a printing target so as to face the ink jet head, wherein each of the plurality of three-dimensional objects being the printing target at least includes, as a print surface to be printed by the ink jet printer, a first print surface, and a second print surface being a side surface relative to the first print surface, the print object retaining section includes:

a shaft member extending in a direction perpendicularly intersecting a direction along which the ink jet head discharges ink droplets, a shaft retaining section that retains the shaft member in a rotatable manner, a three-dimensional object fixing member that is a fixing member fixing the plurality of three-dimensional objects relative to the shaft member, and causes the plurality of three-dimensional objects to rotate together with the shaft member by being fixed relative to the shaft member, and a rotation stopping means for stopping rotation of the shaft member at a predeterminedly set position, wherein the print object retaining section comprises:

a plurality of the three-dimensional object fixing members, each of which is correspondingly fixed to the shaft member, wherein two pieces of the three-dimensional objects of the plurality of the three-dimensional objects are retained in a manner that rear surfaces of the first print surfaces in the two pieces of the three-dimensional objects face each other with the shaft member interposed therebetween, the rotation stopping means stops the rotation of the shaft member at a first angle by which the first print surface faces the ink jet head in case of performing printing on the first print surface of the three-dimensional object, and the rotation stopping means stops the rotation of the shaft member at a second angle by which the second print surface faces the ink jet head in case of performing printing on the second print surface of the three-dimensional object, wherein when the first print surface is a surface larger than the second print surface, the ink jet printer performs printing on the first print surface later than printing on the second print surface.

2. The ink jet printer according to claim 1, wherein the rotation stopping means comprises:

a stepping motor, and a timing belt that causes the shaft member to rotate in accordance with rotation of the stepping motor.

3. The ink jet printer according to claim 1, further comprising a retaining section-driving section that relatively moves the print object retaining section relative to the ink jet head in the direction along which the ink jet head discharges the ink droplets, wherein the retaining section-driving section causes a distance between the ink jet head and the first print surface upon printing on the first print surface, and a distance between the ink jet head and the second print surface upon printing on the second print surface to be in a range of 1.0 to 1.5 mm by relatively moving the print object retaining section relative to the ink jet head.

4. The ink jet printer according to claim 1, wherein the print object retaining section comprises:

a plurality of the shaft members, wherein the rotation stopping means stops rotation of the plurality of the shaft members at the predeterminedly set position by causing the plurality of the shaft members to rotate with same rotation angle.

5. A print method for performing printing using an ink jet scheme on a plurality of three-dimensional objects simultaneously, wherein shapes of the plurality of three-dimensional objects are substantially identical, the method using:

an ink jet head that discharges ink droplets; and a print object retaining member that retains the plurality of three-dimensional objects being a printing target so as to face the ink jet head, wherein each of the plurality of three-dimensional objects being the printing target at least includes, as a print surface to be printed by an ink jet printer, a first print surface, and a second print surface being a side surface relative to the first print surface, the print object retaining member includes:

a shaft member extending in a direction perpendicularly intersecting a direction along which the ink jet head discharges ink droplets, a shaft retaining section that retains the shaft member in a rotatable manner, a three-dimensional object fixing member that is a fixing member fixing the plurality of three-dimensional objects relative to the shaft member, and causes the plurality of three-dimensional objects to rotate together with the shaft member by being fixed relative to the shaft member, and a rotation stopping means for stopping rotation of the shaft member at a predeterminedly set position, wherein the print object retaining section comprises:

a plurality of the three-dimensional object fixing members, each of which is correspondingly fixed to the shaft member, wherein two pieces of the three-dimensional objects of the plurality of the three-dimensional objects are retained in a manner that rear surfaces of the first print surfaces in the two pieces of the three-dimensional objects face each other with the shaft member interposed therebetween, the rotation stopping means stops the rotation of the shaft member at a first angle by which the first print surface faces the ink jet head in case of performing printing on the first print surface of the three-dimensional object, and the rotation stopping means stops the rotation of the shaft member at a second angle by which the second print surface faces the ink jet head in case of performing printing on the second print surface of the three-dimensional object, wherein when the first print surface is a surface larger than the second print surface, the ink jet printer performs printing on the first print surface later than printing on the second print surface.

* * * * *